United States Patent [19]

Baker et al.

[11] Patent Number: 4,699,188

[45] Date of Patent: Oct. 13, 1987

[54] HYGIENIC LIQUID DISPENSING SYSTEM

[76] Inventors: Henry E. Baker, 103 Brookhollow La., Stamford, Conn. 06905; John B. Baker, 306A Maple St., Litchfield, Conn. 06759; David H. Baker, 23 Dancy Dr., Stamford, Conn. 06902; Peter K. Baker, 19 Woodway Rd., Stamford, Conn. 06907

[21] Appl. No.: 820,261

[22] Filed: Jan. 17, 1986

[51] Int. Cl.[4] ..... B65B 3/06

[52] U.S. Cl. ..... 141/18; 141/330; 141/286; 141/364; 215/250; 222/80; 222/146.6; 222/185

[58] Field of Search ..... 141/1-12, 141/18, 19, 329, 330, 286, 363, 364, 365, 366; 215/250, 232, 247; 222/146.1, 146.6, 80-91, 185

[56] References Cited

U.S. PATENT DOCUMENTS

| | | | |
|---|---|---|---|
| Re. 12,352 | 5/1905 | Cole | 222/146 |
| 778,012 | 12/1904 | Conover | 222/146 |
| 996,127 | 6/1911 | Patnaude | 222/146 |
| 1,142,210 | 6/1915 | Wagner | 222/146 |
| 1,228,836 | 6/1917 | Schulse | 222/146 |
| 1,248,705 | 12/1917 | Pogue | 222/146 |
| 1,319,376 | 10/1919 | Cooper | 222/146 |
| 1,658,227 | 2/1928 | Davis, Jr. | 222/146 |
| 2,785,836 | 3/1957 | Smith et al. | 222/146 |
| 4,022,258 | 5/1977 | Steidley | 215/250 |
| 4,576,313 | 3/1986 | Smith et al. | 141/330 |

*Primary Examiner*—Houston S Bell, Jr.
*Attorney, Agent, or Firm*—Joseph J. Kaliko

[57] ABSTRACT

A hygienic liquid dispensing system is disclosed comprised of the combination of a container for the liquid to be dispensed, said container having a neck portion terminating in an aperture for discharging the liquid therethrough; a hygienic cap extending over said aperture and at least a portion of the neck to seal the liquid in the container; and a liquid dispenser, including a sleeve adapted to receive the capped container neck and a sharpened feed tube located within said sleeve for piercing said cap. The container with its capped neck is inverted and lowered into said sleeve and is guided thereby to position the cap over the feed tube. The hygienic cap has a recessed central portion and a relatively thin bottom portion (in said recess) which is pierced by the feed tube as the container is lowered into the sleeve. This piercing allows liquid to flow from the container to the dispenser. The feed tube, cap and sleeve arrangement is such as to insure a closely interfitting seal between the cap and the feed tube prior to the piercing of the cap bottom. This seal, among others that may be formed using the novel cap and dispenser combination, assures the hygienic dispensing of liquid from the inverted container. The dispenser sleeve also serves as a means for supporting the inverted liquid container.

17 Claims, 2 Drawing Figures

HYGIENIC LIQUID DISPENSING SYSTEM

BACKGROUND OF THE INVENTION (1) Field of the Invention

This invention relates to a liquid dispensing system that is maintainable in a hygienic condition such that the amount of contaminants introduced into the system is reduced. More specifically, a bottled water dispensing system is provided where a water dispenser has a feed tube mounted upright in a receptacle for receiving the neck of a water bottle, and a bottle cap secured to the neck has a central recessed portion with a relatively thin bottom portion for being pierced by said pointed feed tube. The recessed portion is protected from contaminants by a peel away covering.

(2) Discussion of the Prior Art

Liquid dispensing apparatus, in particular water coolers using bottled water, are known in the prior art. For example, U.S. Pat. No. 778,012 to Conover; U.S. Pat. No. 996,127 to Patnaude; U.S. Pat. No. 1,228,836 to Schulse; and U.S. Pat. No. 1,319,376 to Cooper all show variations of the basic water dispenser. Other liquids or beverages can be dispensed as well.

These prior art dispensers typically operate in a similar manner. The water to be dispensed is stored in a bottle having a neck surrounding an aperture. The bottle is loaded into a dispenser by lifting and inverting the bottle and placing the neck into a receptacle in the dispenser adapted to hold the bottle in an inverted position. The water can then be discharged through the aperture, through a tube or other passageway formed in the receptacle, and into a chamber in the dispenser, where the water may be cooled or heated if desired. The user may then draw water from the chamber through a stop cock or valve.

The chamber is vented to the atmosphere, and it is known in the prior art to filter the air that enters the chamber from the outside atmosphere. As quantities of water are drawn from the chamber, water is replaced in the chamber from the bottle, and a corresponding volume of air enters the bottle from the chamber through the passageway. Under equilibrium conditions, the water level in the chamber acted upon by atmospheric pressure is balanced by the water level in the bottle. When water is drawn off the chamber and the level therein drops, water from the bottle automatically raises the chamber level and equilibrium is restored.

Certain problems are associated with these prior art devices, however. First, dirt, foreign matter, and other contaminants may settle or collect on or around the neck and aperture of the bottle, and these contaminants may be dumped or scraped into the dispenser receptacle and consequently into the chamber when the bottle is inverted into the receptacle. Second, there may be a good deal of waste as the bottle is upended and placed in the receptacle. Third, if an adequate seal is not maintained between the aperture and the receptacle water leakage will occur over time. An inadequate seal will permit water to leak out, and this water may wash contaminants in the receptacle down into the chamber. Also, an inadequate seal will permit unfiltered air to leak in. If the air surrounding the bottle-dispenser system is contaminated, such as possibly in a factory setting, then this is another way of introducing undesirable levels of contaminants into the water system. While U.S. Pat. No. 996,127 to Patnaude shows a flange on the dispenser adapted to hermetically embrace a stopper projecting from the mouth of a bottle, this apparatus does not solve the problem of a dirty stopper on the bottle.

SUMMARY OF THE INVENTION

In accordance with the present invention, a hygienic cap for a liquid container having a neck surrounding an aperture for the discharge of liquid therefrom into a liquid dispenser is provided, said liquid dispenser having a receptacle or sleeve for receiving the neck and holding the container in an inverted position and a feeding tube mounted in the sleeve for receiving liquid from the container. The cap comprises a cover adapted, in one embodiment, to closely interfit with the sleeve on the dispenser, and the cap has a central recessed portion having a relatively thin bottom portion adapted to be pierced by the feed tube as the neck with the cap thereon is inserted into the sleeve. Means are also provided for securing the cover to the neck of the container.

In a preferred embodiment, the cap comprises a top for extending over the aperture and at least a portion of the neck to seal the liquid inside the container. The top has a central recessed portion with a relatively thin bottom portion for being pierced by a sharpened feed tube as the container is inverted and positioned in the receptacle or mating sleeve. In accordance with this preferred embodiment of the invention, the feed tube has an inner wall portion for discharging liquid from the container and a corresponding outer wall portion for mating with said central recessed portion in the top to restrain leakage. The preferred embodiment of the invention contemplates that the seal formed by the mating of the outer wall of the feed tube with the central recessed portion in the cap top, be achieved prior to the piercing of the cap. The cap may also comprise removable means for covering at least the recessed portion of the top to maintain the sanitary condition of said recessed portion against dirt, dust, or other contaminants that might otherwise collect thereon. The covering means may preferably extend over said recessed portion and at least a part of the exterior of said cap adjacent said recessed portion. Preferably, the covering means comprises a relatively thin member having adhesive applied to one side thereof for adhering to said cap adjacent to and over said recessed portion.

In a particularly preferred embodiment the cap is substantially cylindrical and the recessed portion is formed in approximately the center of the top to have a substantially uniform circular cross section that is coaxial with a cylindrical side wall portion of the cap, the recessed portion mating with a feed tube having a cylindrical outer wall portion. The cylindrical cross section of the recessed portion may be relatively larger adjacent the top portion and relatively smaller adjacent the thinner bottom portion so that the insertion of the feed tube in the recessed portion and also the close mating of the feed tube outer wall portion with said recessed portion is facilitated. Again, the dimensions of the sleeve, feed tube and cap recess are such as to insure that the feed tube/cap seal is achieved first, as the liquid container is lowered into the sleeve, and the cap is punctured thereafter to assure the hygienic dispensing of the liquid.

Also provided in accordance with an alternate embodiment of the present invention is a hygienic bottled liquid dispensing system comprising a bottle cap adapted to closely interfit with a mating sleeve on a dispenser, the cap having a central recessed portion having a relatively thin bottom portion adapted to be pierced by a feed tube. The corresponding liquid dispenser has an upwardly extended sleeve, the sleeve being closely interfitable with the cap, and a liquid feed tube is mounted in the sleeve and has a sharpened end for piercing the bottom of said recessed portion. Preferably the height of said feed tube is less than the height of said sleeve and the depth of said recessed portion whereby said sleeve and said cap are coupled in close sealing engagement before said bottom portion is pierced by said feed tube.

In a particularly preferred version of this alternate embodiment, the water dispensing means has an upwardly extending sleeve with an inner wall for receiving a cap mounted on the neck of the bottle, the cap having means for mating with said inner wall to further seal the water inside the bottle, and the water dispensing means also has a feed tube means mounted inside the sleeve and extending upwardly therein for piercing the relatively thin bottom wall of the cap.

It is an object of the present invention to provide a hygienic cap for a liquid container for use with a liquid dispenser, such that the cap is maintained in a relatively sanitary condition to avoid the depositing of contaminants into the system when a bottle bearing the cap is inserted or loaded into the liquid dispenser.

It is a further object of the present invention to provide a hygienic cap for a liquid container to be used in conjunction with a liquid dispenser, whereby the cap engages the liquid dispenser in a close fitting manner to reduce the leakage of water out of the bottle and the leakage of air into the bottle.

It is a further object of the present invention to provide a hygienic bottle water dispensing system that reduces leakage of water out of the bottle and leakage of air into the bottle, thereby maintaining the hygienic or sanitary condition of the system against contaminants that may be present in the air adjacent the dispensing system.

Further objects and advantages of the present invention will become apparent from the following description.

DETAILED DESCRIPTION OF THE PREFERRED EMBODIMENT

Figure 1:
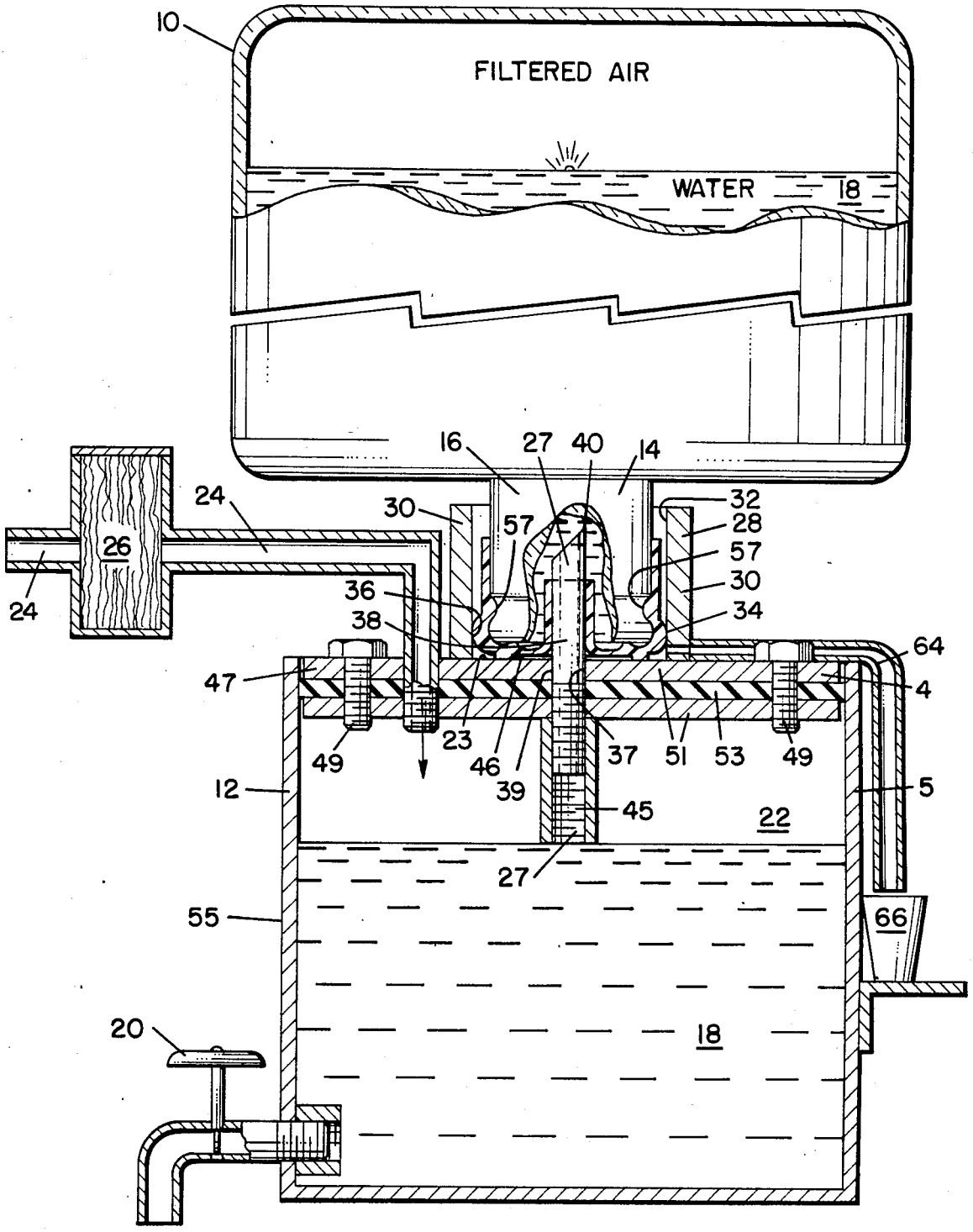
FIG. 1 shows a partial cross-sectional view with cutaway of the hygienic liquid dispensing system of the present invention, including a cap suitable for use as part of the present invention as mounted on the container and loaded into the dispenser.

Referring to FIG. 1, a liquid container 10 is shown inverted and loaded into a liquid dispenser 12. Container 10 is typically a bottle comprising glass, polycarbonate, or other suitable material with a neck 14 formed therein surrounding an aperture 16 for the discharging therethrough of liquid 18, usually water or other desired beverage, into a chamber 22 in dispenser 12. Container 10 is in fluid communication with chamber 22 through passageway 27, which is a feed tube 38 described in more detail below. Liquid 18 may then be drawn off by the user in controlled amounts as desired through stopcock or valve 20. The container, including the neck, is usually of substantially circular cross section, although other configurations can be used in accordance with the present invention.

As liquid 18 is drawn off through valve 20, air enters chamber 22 through conduit 24, which has an air filter element 26 disposed therein for filtering the incoming air. Equilibrium levels of liquid are maintained in both chambers 22 and container 10 above the liquid level by well known principles of fluid mechanics.

The neck 14 of container 10 is shown inverted into and supported by a receptacle 28 mounted on dispenser 12. Receptacle 28 is adapted to receive and mate with neck 14 and secures the inverted container 10 thereabove in a balanced position. As shown in FIG. 1, receptacle 28 preferably comprises an upwardly extending cylindrical sleeve 30 having a length sufficient to accommodate neck 14. The receptacle 28 also has a floor 23 to shield the chamber 22 from debris that may be on the bottle or cap. An additional benefit of keeping the bottle remote from the chamber is to thermally insulate the chamber with respect to the bottle. In the embodiment depicted in FIG. 1, sleeve 30 has an inner wall 32 for mating with a cap 34 secured onto the neck of container 10. The inner wall 32 is preferably dimensioned so as to provide a close fit with a cylindrical outer surface portion 36 on cap 34, thereby inhibiting the leakage of water out and the leakage of air in at the point where surface 36 abuts inner wall 32. In an optional, and indeed the preferred embodiment of the invention, the sleeve 30/surface 36 seal is not required. The preferred embodiment of the invention will allow bottle necks of varying diameter to be guided by sleeve 30 over and onto feed tube 38. According to the preferred embodiment of the invention, the key seal among the several different seals taught hereinafter is the one made prior to the piercing of cap 34 by feed tube 38, between the feed tube and the cap itself.

Feed tube 38 is mounted, preferably coaxially, inside sleeve 30 and may have a sharpened end 40 adapted for sliding into a central recessed portion 42 of cap 34 and piercing a relatively thin bottom portion 44 of cap 34. The tube is preferably of cylindrical cross section with an inner wall portion 37 for discharging liquid 18 from container 10. Tube 38 also has a corresponding outer wall portion 39 for slidably abutting and mating with central recessed portion 42. When the bottom portion 44 is pierced by sharpened end 40, end 40 extends partially into container 10 for discharging liquid therefrom into chamber 22. The abutting and mating of outer wall portion 39 of tube 38 with recessed portion 42 of cap 34 is to occur prior to the piercing of bottom 44. This abutting and mating corresponds to the forming of the aforementioned key seal in accordance with the preferred embodiment of the invention. The end of feed tube 38 opposite sharpened end 40 extends downwardly and terminates in chamber 22, preferably having a fitting 45 threaded thereon for extending the length of the feed tube and may be adjustable to change the water level in the chamber as desired. Having a seal where the bottle cap joins the upwardly extending feed tube permits the use of a larger diameter feed tube where it empties out into the chamber. This accomodates smoother operation of the system. The tube can be apertured in the end or the side to receive water from the container.

Receptacle 28 is mounted onto the top covering 47 of chamber 22. Receptacle 28 can be formed of any suitable metal or plastic, and if metal can be welded or brazed onto covering 47. Covering 47 can be secured over chamber 22 by a plurality of bolts 49 that squeeze two plates 51 together and force a neoprine gasket 53 outward to engage the sidewalls 55 forming chamber 22. Covering 47 is apertured to receive air passageway 24. Alternatively, chamber 22, covering 47, and receptacle 28 could be integrally formed as one piece.

Figure 2:
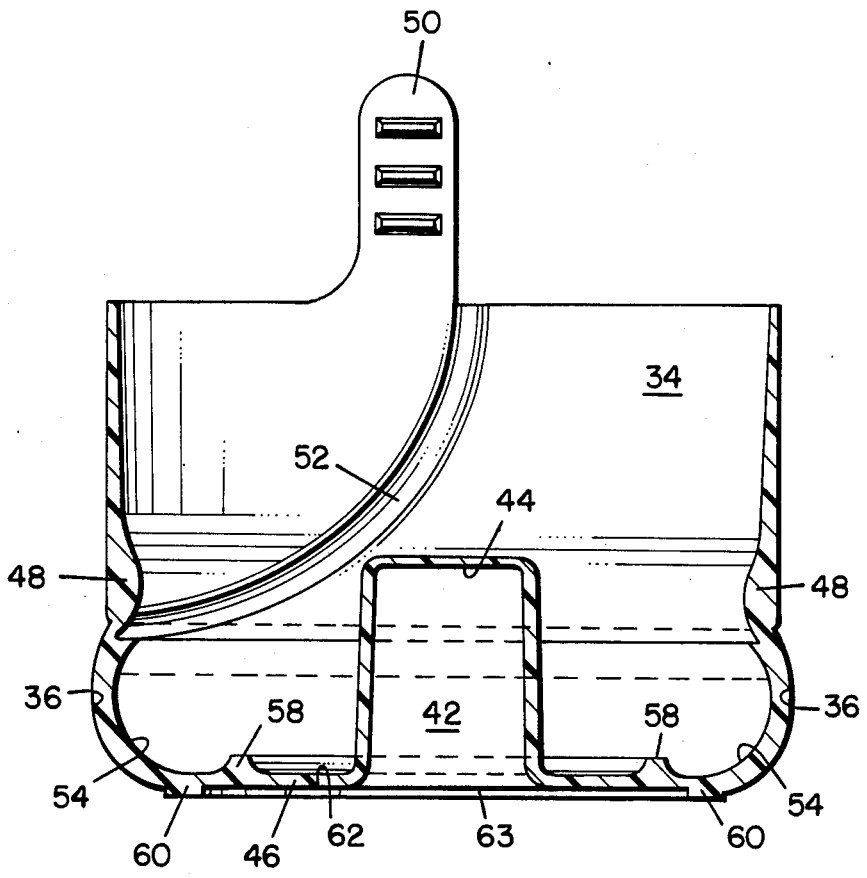
FIG. 2 shows a cross-sectional view of the cap of FIG. 1.

FIG. 2 shows a version of cap 34 of the present invention in more detail. Cap 34 comprises a cover or lid portion 46 having the central recessed portion 42. Cap 34 is cylindrical and comprises an outside surface portion 36 adapted to closely interfit with mating sleeve 30, as described above with reference to one embodiment of the invention. Recessed portion 42 has a relatively thin bottom portion 44 adapted to be pierced by the sharpened feed tube 38. Recessed portion 42 is preferably formed approximately in the center of the cover 46 to have a substantially uniform circular cross section coaxial with said cylindrical sidewall.

Cap 34 is secured to the neck of container 10 so that the cover 46 seals the liquid contents in the container 10 until the container is loaded into the receptacle 28 and the bottom portion 44 is pierced to permit controlled liquid discharge into chamber 22. The cap 34 is preferably retained on the neck by an annular portion 48 of material extending inwardly around the cap interior, which cooperates with a corresponding groove 57 in the bottle neck, so that the cap is restrained from being forced off the container. A pull tab 50 adjacent an angled thinner side wall portion 52 of the cap permits the cap to be torn for easy removal from the bottle neck.

Cap 34 has a shaped inner surface 54 for mating in a close conforming fit with neck 14 of container 10 in a region adjacent aperture 16, whereby the liquid contents of the container are sealed therein. An annular ring of cap material 58 extends partially inside the aperture for achieving a close fitting seal of the cap against the neck. As already described above, the outer wall of cap 34 may, in accordance with one embodiment of the invention, form a cylindrical surface 36 for abutting the inner wall 32 of the extended sleeve. Also, in yet another embodiment of the invention, an annular portion of cap material 60 extends downward to further seal the liquid contents of the container against leaking out at the floor 23 of the receptacle.

Annular portion 60 of cap 34 further defines a shallow cavity 62, substantially centered on the central recessed portion 42 for receiving removable or pull away means such as an adhesive tab for covering at least the recessed portion to maintain the sanitary condition of that portion of the cap. This removable means is preferably a relatively thin member, such as cardboard or foil backed plastic, having adhesive applied to one side thereof for adhering to cap 34 inside the shallow cavity portion 62. This removable means or tab 63 thereby serves to keep the top portion of the cover 46 clean until use. Otherwise, if as is often the case, the capped container is stored upright for a period of time, dirt, dust, and possibly other contaminants may collect on the cover 46, only to be dumped or scraped into receptacle 28 when the user inverts the container 10 for insertion into the receptacle. Also, any leakage of liquid into the receptacle tends to wash contaminants from the face of the top 46 into the chamber 22. If container 10 is stored in an industrial area where toxic dusts or compositions may settle out of the air, it is particularly critical that this peel away member be used to prevent serious contamination of the system.

The cap 34 may be made of any material that can be formed to fit snugly against the container neck 14, is tough enough to resist tearing or puncturing while the container 10 is stored, but is capable of being neatly punctured by feed tube 38. A particularly preferred material is low density polyethylene, although other suitable materials can also be used.

The central recessed portion 42 of cap 34 is preferably of circular cross section to mate with a circular or hollow cylindrical feed tube 38. Recessed portion 42 has a circular cross section that, while substantially uniform along its length, is larger adjacent the lid or cover 46 so as to facilitate the reception of the feed tube 38 therein without accidental puncturing or tearing as the container is inserted into the receptacle 28.

This objective is further accomplished by suitably sizing the interior diameter of the receptacle 28 in relation to the cap 34 so that proper alignment is easily and uniformly achieved as the inverted bottle is loaded by the user. The circular cross section of the recessed portion 42 is reduced toward the end adjacent the relatively thin bottom portion 44 so that the feed tube outer wall 39 can fit snugly against the recessed portion. This snug fit inhibits leakage of liquid from the container 10 into the receptacle area as the feed tube pierces the bottom portion during loading and also after loading is complete and the tube extends into the container 10. Again, the preferred embodiment of the invention contemplates this "snug fit" seal to be achieved before the feed tube pierces the cap.

If there is any leakage of liquid into receptacle 28, which may be sometimes unavoidable as a practical matter, then a drain tube 64 and drip pan 66 collect the overflow. The drip pan 66 can be periodically emptied by the user.

Thus, in accordance with one embodiment of the invention, the dimensions of the feed tube 38, the mating sleeve 30 of the receptacle 28, and the recessed portion 42 of cap 34 are chosen so that sleeve 30 and the outside surface portion 36 of cap 34 are coupled in close sealing engagement before the bottom portion 44 is pierced by the feed tube. Additionally and alternatively, the preferred embodiment of the invention, as the example that follows illustrates, calls for outer wall 39 of feed tube 38 to be placed in close sealing engagement with central recessed portion 42 of cap 34, prior to bottom portion 44 being pierced by the feed tube. The dimensions can be chosen to accommodate any existing variations in bottle styles and dimensions. By way of example only, the feed tube 38 can measure approximately one inch from the floor of the receptacle to the end of the sharpened tip, and the mating sleeve 30 is approximately three inches, so that the capped neck inserted in the receptacle mates snugly with the sleeve as it slides downwardly to engage the pointed end of the feed tube. For this example, in accordance with the preferred embodiment of the invention, the depth of the recessed portion would preferably be approximately $\frac{3}{4}$ inches, so that the outer wall portion of the feed tube 38 has snugly engaged the recessed portion before piercing occurs.

It should be understood that various changes and modifications to the preferred embodiment described above will be apparent to those skilled in the art. Such changes and modifications can be made without departing from the spirit and scope of the present invention, and it is therefore intended that such changes and modifications be covered by the following claims.

I claim:

1. A liquid dispensing system, including a chamber serving as a liquid reservoir, a reservoir discharge valve and a supported supply container, comprising:

(a) a cap adapted to fit on said container, said cap having a recessed central portion and a relatively thin bottom portion positioned in said recessed portion;

(b) a liquid dispenser including a sleeve for receiving said cap; and (c) a feed tube in said sleeve, said feed tube being of a height substantially less than the height of said sleeve interior and said recessed central portion of said cap whereby said feed tube and said recessed portion are coupled in closely sealing engagement prior to piercing of said cap bottom by said feed tube as the container with said cap thereon is inverted into said sleeve of said dispenser to prevent liquid from leaking from said container around said feed tube after said container is inverted and said cap is pierced.

2. A liquid dispensing system as set forth in claim 1 wherein said sleeve acts to guide the capped container onto said feed tube.

3. A liquid dispensing system as set forth in claim 1 wherein said sleeve acts to support the capped container.

4. A liquid dispensing system as set forth in claim 1 wherein said sleeve is adapted to closely interfit with said cap whereby said cap and sleeve are placed in close sealing engagement prior to said cap being pierced by said feed tube.

5. A leak proof liquid dispensing system, including a chamber serving as a liquid reservoir, a reservoir discharge valve and a bottle for containing liquid to be dispensed, said bottle having a neck portion terminating in an aperture for discharging said liquid therethrough, comprising:

(a) a cap for securing onto said neck to seal liquid in said bottle, said cap having a central recessed portion for extending through said aperture partially into said container, said recessed portion having a relatively thin bottom wall adapted to be pierced; and (b) liquid dispensing means for receiving liquid from said bottle discharged through said aperture and dispensing same to a user, said dispensing means having (i) an upwardly extending sleeve with an inner wall for receiving said cap mounted on said neck portion and supporting said bottle in an inverted position thereabove for discharging said liquid through said aperture into said dispensing means, said cap having means for mating with said inner wall to further seal the liquid inside said bottle; and (ii) feed tube means mounted inside said sleeve and extending upwardly therein, said tube means for piercing said bottom wall, mating with said recessed portion to prevent leakage of liquid therearound into said receptacle, and extending into said bottle for conducting said liquid into said dispenser, said tube means also having a sharpened end for piercing said bottom wall portion whereby said liquid can be delivered into said dispensing means in a hygienic manner.

6. The system of claim 5, wherein the length of said feed tube means is less than the height of said sleeve, whereby said feed tube means will sealingly engage said recessed portion before said bottom wall portion is pierced as said neck with said cap thereon is inserted into said sleeve.

7. The system of claim 6, wherein said recessed portion has a depth at least as great as the difference between the length of said sleeve and the height of said feed tube means, said depth also being less than the height of said feed tube means, whereby said recessed portion and said tube are coupled in close sealing engagement before said bottom portion is pierced by said feed tube.

8. The system of claim 7 wherein air from outside the dispenser enters the bottle through said feed tube means as liquid is discharged into said dispenser, and said system further comprises means connected to said dispenser for filtering the air that enters said liquid bottle through said feed tube means as liquid is discharged therethrough.

9. The system of claim 8, wherein said dispenser comprises a reservoir and means for sealingly engaging said reservoir, and said sleeve is mounted on said engaging means above said reservoir and said tube means extends through said cover into said reservoir, and said cover forms a passageway for the entry of air into the reservoir, whereby air can replace the liquid in said bottle through said feed tube means as said liquid is discharged into said reservoir, and said filter means is disposed in said passageway for filtering the air that enters the reservoir.

10. A leak proof liquid dispensing system, including a chamber serving as a liquid reservoir, a reservoir discharge valve and a bottle for containing liquid to be dispensed, said bottle having a neck portion terminating in an aperture for discharging said liquid therethrough, comprising:

(a) a cap for securing onto said neck to seal said liquid in said bottle, said cap having a central recessed portion for extending through said aperture partially into said container, said recessed portion having a relatively thin bottom wall adapted to be pierced; and (b) liquid dispensing means for receiving liquid from said bottle discharged through said aperture and dispensing same to a user, said dispensing means having (i) An upwardly extending sleeve with an inner wall for receiving said cap mounted on said neck portion and supporting said bottle in an inverted position thereabove for discharging said liquid through said aperture onto said dispensing means; and (ii) feed tube means mounted inside said sleeve and extending upwardly therein, said tube means for piercing said bottom wall, mating with said recessed portion to prevent leakage of liquid therearound into said receptacle, and extending into said bottle for conducting said liquid into said dispenser, said tube means also having a sharpened end for piercing said bottom wall portion whereby said liquid can be delivered into said dispensing means in a hygienic manner.

11. The system of claim 10, wherein the length of said feed tube means is less than the height of said sleeve, whereby said feed tube means will sealingly engage said recessed portion before said bottom wall portion is pierced as said neck with said cap thereon is inserted into said sleeve.

12. The system of claim 11, wherein said recessed portion has a depth at least as great as the difference between the length of said sleeve and the height of said feed tube means, said depth also being less than the height of said feed tube means, whereby said recessed portion and said tube are coupled in close sealing engagement before said bottom portion is pierced by said feed tube.

13. The system of claim 12 wherein air from outside the dispenser enters the bottle through said feed tube means as liquid is discharged into said dispenser, and said system further comprises means connected to said dispenser for filtering the air that enters said liquid bottle through said feed tube means as liquid is discharged therethrough.

14. The system of claim 13, wherein said dispenser comprises a reservoir and means for sealingly engaging said reservoir, and said sleeve is mounted on said engaging means above said reservoir and said tube means extends through said cover into said reservoir, and said cover forms a passageway for the entry of air into the reservoir, whereby air can replace the liquid in said bottle through said feed tube means as said liquid is discharged into said reservoir, and said filter means is disposed in said passageway for filtering the air that enters the reservoir.

15. A liquid dispensing system, including a chamber serving as a liquid reservoir, a reservoir discharge valve and a supported supply container, comprising:

(a) a cap for said liquid container wherein the cap has a central recessed portion and further wherein the cap is adapted to be received within a sleeve on a dispenser, said recessed portion having a bottom portion adapted to be opened by a feed tube on said dispenser;

(b) a liquid dispenser having an upwardly extending sleeve, for receiving, guiding and supporting said liquid container with said cap affixed thereto; and (c) a liquid feed tube which has an end suitable for opening the bottom of said recessed portion, the height of said feed tube being less than the height of said sleeve and the depth of said recessed portion, whereby said feed tube and said recessed portion are coupled in close sealing engagement before said bottom portion is opened by said feed tube to prevent liquid from leaking from said container around said feed tube after said cap is opened.

16. A liquid dispensing system, including a chamber serving as a liquid reservoir, a reservoir discharge valve and a supported supply container, comprising:

(a) a cap for said liquid container wherein the cap has a central recessed portion and further wherein the cap is adapted to closely interfit with a sleeve on a dispenser so as to permit said cap and sleeve to be placed in close sealing engagement, said recessed portion having a bottom portion adapted to be pierced by a feed tube on said dispenser;

(b) a liquid dispenser having an upwardly extending sleeve for receiving, guiding and supporting said liquid container with said cap afixed thereto, said sleeve being closely interfittable with said cap; and (c) a liquid feed tube which has an end suitable for piercing the bottom of said recessed portion, the height of said feed tube being less than the height of said sleeve and the depth of said recessed portion, whereby said feed tube and said recessed portion are coupled in close sealing engagement and said cap and said sleeve are also coupled in close sealing engagement before said bottom portion is pierced by said feed tube to prevent liquid from leaking from said container around said feed tube after said cap is pierced.

17. A liquid dispensing system, including a chamber serving as a liquid reservoir, a reservoir discharge valve and a supported supply container, comprising:

(a) a cap adapted to fit on said container, said cap having a recessed central portion and a relatively thin bottom portion positioned in said recessed portion;

(b) a feed tube in said sleeve, said feed tube being of a height substantially less than the height of said sleeve interior and said recessed central portion of said cap; and (c) a liquid dispenser, including a sleeve for receiving, supporting and guiding the recessed central portion of said cap onto said feed tube whereby only the thin bottom portion of said cap is pierced by said feed tube.

* * * * *